United States Patent [19]

Nakatomi

[11] 4,370,968

[45] Feb. 1, 1983

[54] ELECTRONICALLY CONTROLLED, FUEL INJECTION METHOD

[75] Inventor: Takayoshi Nakatomi, Susono, Japan

[73] Assignee: Toyota Jidosha Kogyo Kabushiki Kaisha, Toyota, Japan

[21] Appl. No.: 208,814

[22] Filed: Nov. 20, 1980

[30] Foreign Application Priority Data

Jul. 25, 1980 [JP] Japan ..... 55/101092

[51] Int. Cl.[3] ..... F02B 3/00

[52] U.S. Cl. ..... 123/488; 123/492

[58] Field of Search ..... 123/440, 488, 492

[56] References Cited

U.S. PATENT DOCUMENTS 4,130,095 12/1978 Bowler ..... 123/440

4,235,204 11/1980 Rice ..... 123/488

4,245,590 1/1981 Grozinger ..... 123/488

*Primary Examiner*—Ronald B. Cox

*Attorney, Agent, or Firm*—Cushman, Darby & Cushman

[57] ABSTRACT

An electronically controlled fuel injection method for controlling a fuel injection valve of an intake system by electric signals characterized in that: from an input level $X_{n-1}$ to be fed into a computation section from sensors at a previous fuel injection rate computation time $T_{n-1}$, an input level $X_n$ to be fed into the sensors at a present fuel injection rate computation time $T_n$, a delay time until a physical amount to be detected reaches an input point in the computation section by way of the sensors, and a time $A_n$ at which a cylinder to which a fuel is supplied by an amount based on the present fuel injection rate computation reaches a bottom dead center on a subsequent intake stroke, the following equation is computed;

$$C_n = (X_n - X_{n-1}) \cdot \frac{1}{T_n - T_{n-1}} \cdot (\tau + A_n - T_n) + X_n$$

and, $C_n$ is used as data on the physical amount for executing a present fuel injection rate computation.

5 Claims, 2 Drawing Figures

ELECTRONICALLY CONTROLLED, FUEL INJECTION METHOD

BACKGROUND OF THE INVENTION

1. Field of the Invention

This invention relates to an electronically controlled, fuel injection method for an automobile engine.

2. Description of the Prior Art

Conventionally, in an electronically controlled, fuel injection method, a computation section computes a rate of fuel being injected according to input signals transmitted from respective sensors. For example, in order to obtain data on a flow rate of intake air, an intake pipe pressure is detected by an intake pipe pressure sensor. In order to remove surge of the intake pipe pressure and noise originating from an ignition system, the output of the intake pipe pressure sensor is processed by a filter to be transported to the computation section. Accordingly, a delay in response due to a time constant of respective sensor and that of filter results. The computation of a rate of fuel being injected is ideally executed on the basis of a time required, namely, data on respective physical amount at a time at which a cylinder into which a fuel is injected reaches the bottom dead center on the intake stroke. Since injection of fuel requires a predetermined duration, fuel must be injected prior to a time required, and a fuel-injection-rate computation time is earlier to a considerable extent than the required time at which ideal data are obtained. Thus, a delay in response of the aforesaid sensor results, with the accompanied poor accuracy in a rate of fuel being injected at the transition, such as at the acceleration of an engine.

SUMMARY OF THE INVENTION

It is accordingly an object of the present invention to provide an electronically controlled, fuel injection method, wherein irrespective of a delay in response of sensors and a delay time between a computation time and a time required, a rate of fuel actually necessary for an engine is properly computed and injected.

To attain the object, from an input level $X_{n-1}$ to be fed into a computation section from a sensor at a previous fuel injection rate computation time $T_{n-1}$, an input level $X_n$ to be fed into the computation section from the aforesaid sensor at a subsequent fuel injection rate computation time $T_n$, a delay time $\tau$ until a physical quantity to be detected reaches an input point in the computation section by way of the aforesaid sensor, and a time $A_n$ at which a cylinder into which a fuel is supplied by an amount set by the present fuel injection rate computation reaches a bottom dead center on a subsequent intake stroke, the following computation is made:

$$C_n = (X_n - X_{n-1}) \cdot \frac{1}{T_n - T_{n-1}} \cdot (\tau + A_n - T_n) + X_n$$

In terms of $C_n$ being representative of data on the aforesaid physical amount, computation of a present fuel injection rate is executed. Thus, the input level $X_n$ from the sensor at the computation time $T_n$ is rectified by addition of increments with lapse of a time $\tau$ and $A_n - T_n$, and the value $C_n$ thus obtained is substantially equal to a value of the physical amount at the time required. As a result, accuracy in a rate of fuel being injected is achieved, responseness at the transistion is greatly improved, and an amount of unburnt hydrocarbon being exhausted is controlled.

DESCRIPTION OF THE PREFERRED EMBODIMENTS

Figure 1:
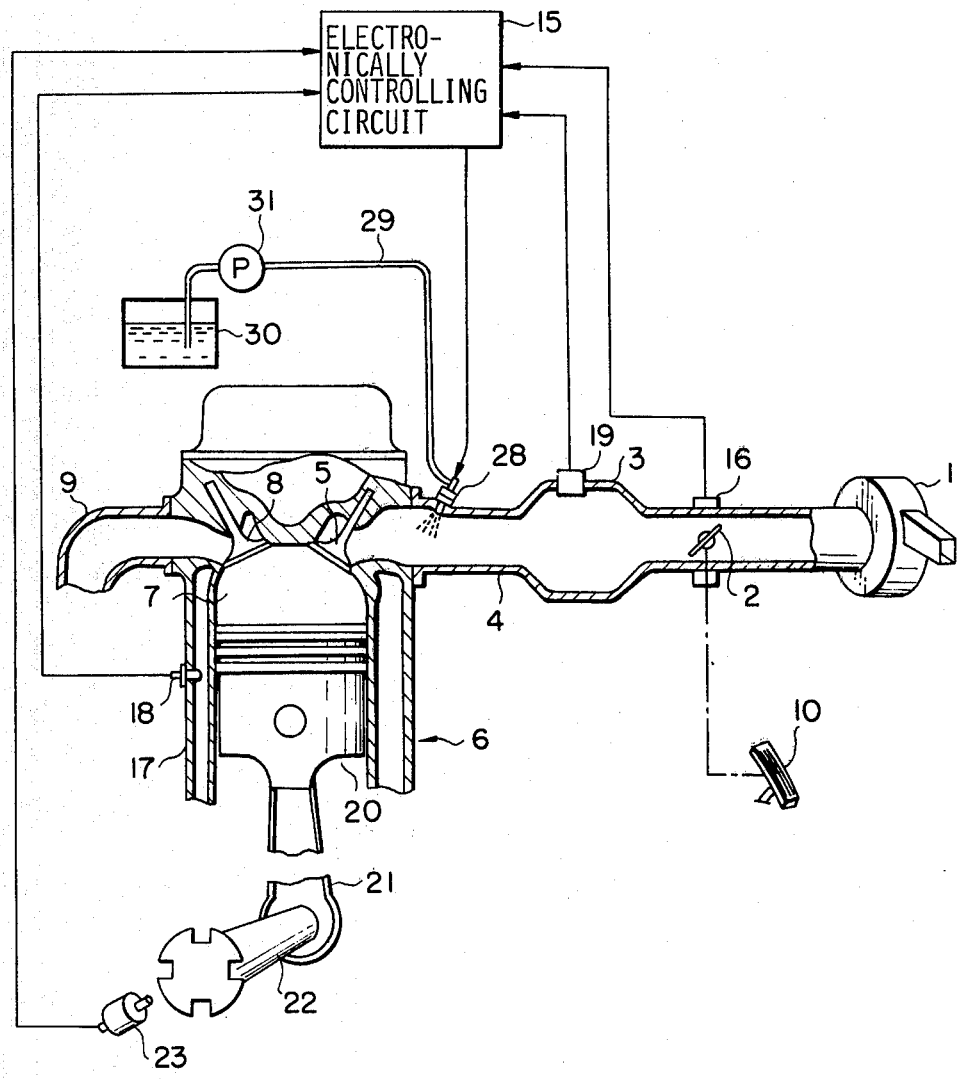
FIG. 1 is a schematic view of an electrically controlled fuel injection device to which the method of the present invention is applied.

Referring to FIG. 1 showing an outline of an electronically controlled fuel injection device to which the method of the present invention is applied, an intake air drawn under from an air cleaner 1, is supplied via a surge tank 3, an intake pipe 4 and an intake valve 5 into a combustion chamber 7 in an engine body 6, while a flow rate thereof is controlled by a throttle valve 2 interlocking with an acceleration pedal 10 in a driver's room. The mixture charge burnt in the combustion chamber 7 is discharged as exhaust gases via an exhaust valve 8 and an exhaust manifold 9. A fuel injection valve 14 is provided in respective intake manifold 4 corresponding to respective combustion chamber. An electronically controlling circuit 15 includes elements such as a micro-processor serving as a computation portion, a read only memory ROM, a random access memory RAM and a filter. The electronically controlling circuit 15 receives input signals from a throttle sensor 16 for detecting the opening of the throttle valve 2, a water temperature sensor 18 attached to a water jacket 17 in the engine body 6, an intake pipe pressure sensor 19 provided in the surge tank 3, and a crank-angle sensor 23 for detecting rotation of a crank shaft 22 connected by way of a connecting rod 21 to a piston 20, and transmits pulse signals indicating a rate of fuel being injected to a fuel injection valve 28 provided in the vicinity of an intake port. Fuel is supplied under pressure, by a fuel pump 31, from a fuel tank 30 by way of a fuel passage 29 into the fuel injection valve 28. The micro-processor in the electronically controlling circuit 15 computes a rate of fuel being injected according to input signals from the intake pipe pressure sensor 19, etc. in synchronism with the input signal from the crank-angle sensor 23.

Figure 2:
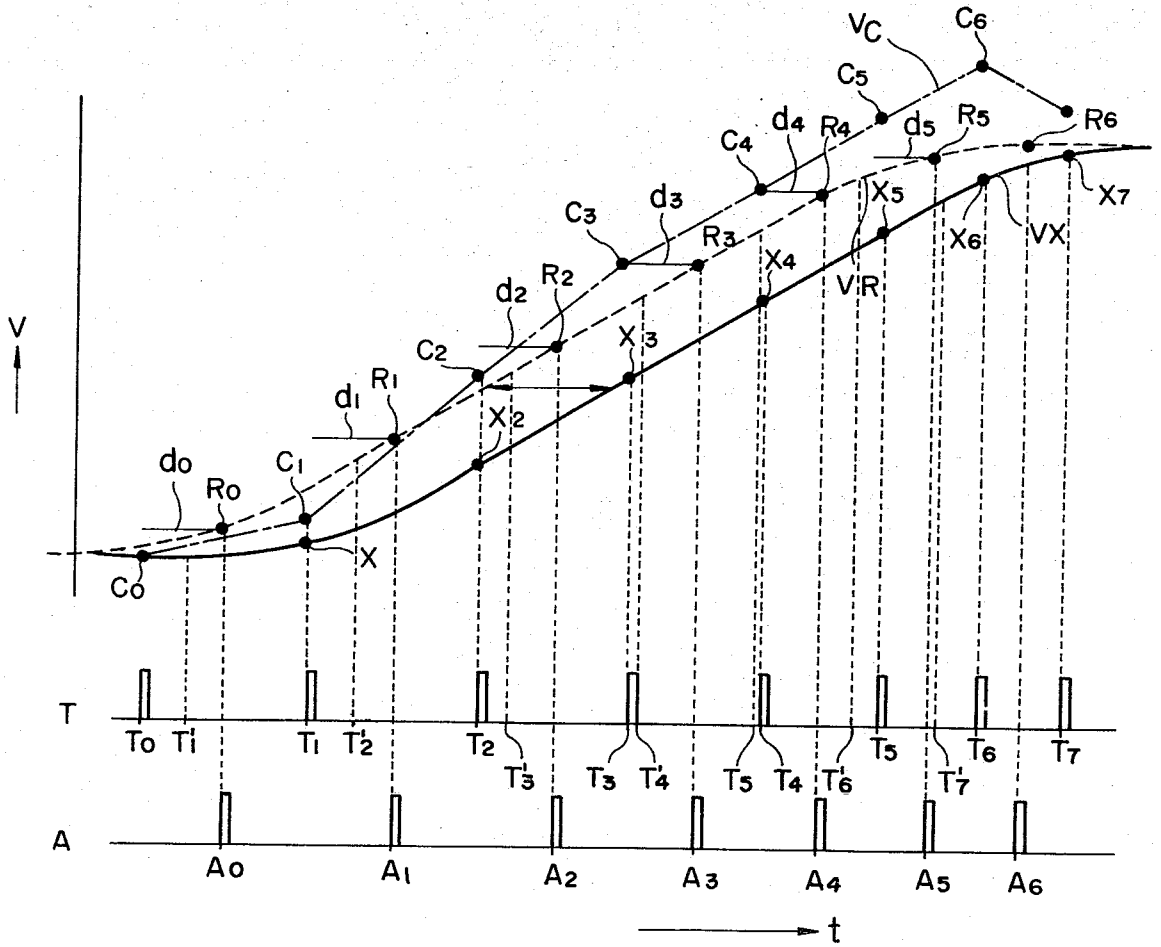
FIG. 2 is a graph representing the relationship among a fuel injection rate computation time, a time required, and an intake pipe pressure.

Referring to FIG. 2, there is indicated along an abscissa a time t, such as a series T of fuel injection rate computation times $T_o$, $T_1$ . . . , and a series A of required times $A_o$, $A_1$ . . . at which a cylinder into which a fuel is injected by an amount set according to the fuel injection rate computation reaches the bottom dead center on the intake stroke. An intake pipe pressure V is indicated along an ordinate, $T_o$, $T_1$ and $A_o$,$A_1$ . . . indicate a time at which a pulse rises (the leading edge of a pulse). Regarding the intake pipe pressure V, a broken line $V_R$ indicates a curve of an actual intake pipe pressure at that time, a solid line $V_X$ indicates a curve of an intake pipe pressure which the computation section uses as an input at the fuel injection rate computation time. With respect to $V_R$, $V_X$ exhibits a delay by a duration of time equivalent to a time constant of the intake pipe pressure sensor and a time constant of a filter. A one-dotted line $V_C$ indicates a curve which plots the values obtained by correcting the curve $V_X$ by a below-described equation (1). $X_1$,$X_2$ . . . represent values of the intake pipe pressure at respective computation times $T_1$, $T_2$ . . . on the curve $V_X$; $R_1, R_2$ . . . represent values of intake pipe pressure at respective required times $A_o, A_1$ on the curve $V_R$, and $C_1, C_2$ . . . indicate values of the intake pipe pressure at respective computation times $T_1, T_2$ . . . on the curve $V_C$. Lines $d_o, d_1, d_2$ . . . running in parallel to the time-indicating axis in an opposite direction to the lapse of a time respectively have a length equal to a difference $A_o - T_o$, $A_1 - T_1$, . . . between the required time and the computation time corresponding thereto. From this, it is clearly seen that $R_o, R_1$ . . . correspond to $C_o, C_1$ . . . $T_1'$, $T_2'$ . . . are set to be equal to $T_1 - \tau$, $T_2 - \tau$. Consequently, the values of the intake pipe pressure at the times $T_1'$, $T_2'$ . . . with respect to the curve $V_R$ become equal to $X_1$, $X_2$ . . . FIG. 2 shows the case where the intake pipe pressure increases, stated otherwise, the engine is run in the acceleration mode.

In the computation time $T_n$ (n is an integer), a correction value $C_n$ is computed by the following equation:

$$C_n = \frac{X_n - X_{n-1}}{T_n - T_{n-1}} \cdot (\tau + A_n - T_n) + X_n \quad (1)$$

In consolidating the variables and constants which have been referred to in conjunction with FIG. 2;

$C_n$: Values corrected $T_n$: Present fuel injection rate computation time $T_{n-1}$: Previous fuel injection rate computation time $X_n$: Input level to be fed into computation section at the time $T_n$ regarding the intake pipe pressure.

$X_{n-1}$: Input level to be fed into computation section at the time $T_{n-1}$ regarding the intake pipe pressure.

$\tau$: A delay time at which the intake pipe pressure to be detected arrives in delay at the input point of the computation section due to the time constant of the intake pipe pressure sensor and that of the filter.

$A_n$: A time at which a cylinder into which a fuel is supplied by an amount set by the fuel injection rate computation at the time $T_n$ reaches the bottom dead center on a subsequent intake stroke.

It is ideal that computation of a rate of fuel being injected in the computation section is executed on the basis of the data at the time $A_3$. However, injection of fuel requires a predetermined duration, and must terminate by the time $A_3$. Furthermore, computation of fuel injection must be executed on the basis of a physical amount earlier to a considerable duration than the time required. In this embodiment, a time at which the intake pipe vacuum serving as input data in the computation of fuel injection has actually existed is $T_n'$, and there exists a difference in time $A_n - T_n'$ $(= A_n - T_n + \tau)$ between the time $T_n'$ and the time required $A_n$. In the equation (1), $(X_n - X_{n-1})/(T_n - T_{n-1})$ represents mean inclination approximate to the time $T_n'$ on the curve $V_R$; $\tau + R_n - T_n$ represents the aforesaid difference in time. Therefore, $$\frac{X_n - X_{n-1}}{T_n - T_{n-1}} \cdot (\tau + A_n - T_n)$$

represents increment in the intake pipe pressure between the times $A_n$ and $T_n'$, and $C_n$ can be deemed as an approximate value of the actual intake pipe pressure at the time $A_n$. $C_o$, $C_1$ . . . on the curve $V_C$ in FIG. 2 are values obtained from $X_o$, $X_1$ . . . , and it is clearly seen that these values are substantially equal to $R_o$, $R_1$ . . . on the curve $V_R$.

In computation of fuel injection in the computation section, $C_n$ is used as data on the intake pipe pressure. Computation of a rate of fuel being injected is executed according to substantially the actual intake pipe pressure at the required time $A_n$. As a result, a large difference between $X_o$, $X_1$ . . . and $R_o$, $R_1$ . . . at the transistion is produced. In the conventional electronically controlled fuel injection method, a rate of fuel being injected is determined according to $X_o$, $X_1$ . . . , resulting in poor accuracy in a rate of fuel being injected. In contrast thereto, according to the method of the present invention, the accuracy in a rate of fuel being injected is achieved, responseness at the transition is greatly improved, with the reduction in an amount of unburnt hydrocarbon being exhausted.

In this embodiment, description has been given on the basis of the intake pipe pressure, and $C_n$ and $X_n$ may be applied to physical amounts other than the intake pipe pressure.

What is claimed is:

1. An electronically controlled fuel injection method for controlling a fuel injection valve of an intake system by electric signals characterized in that; from an input level $X_{n-1}$ to be fed into a computation section from sensors at a previous fuel injection rate computation time $T_{n-1}$, an input level $X_n$ to be fed into said sensors at a present fuel injection rate computation time $T_n$, a delay time until a physical amount to be detected reaches an input point in the computation section by way of said sensors, and a time $A_n$ at which a cylinder to which a fuel is supplied by an amount based on the present fuel injection rate computation reaches a bottom dead center on a subsequent intake stroke, the following equation is computed;

$$C_n = (X_n - X_{n-1}) \cdot \frac{1}{T_n - T_{n-1}} \cdot (\tau + A_n - T_n) + X_n$$

and, $C_n$ is used as data on said physical amount for executing a present fuel injection rate computation.

2. An electronically controlled fuel injection method as defined in claim 1, wherein said physical amount is an intake pipe pressure.

3. An electronically controlled fuel injection method as defined in claim 2, wherein the intake pipe pressure is detected in the surge tank provided on the downstream of a throttle valve in the intake system.

4. An electronically controlled fuel injection method as defined in claim 3, wherein a time at which the cylinder reaches at the bottom dead center on said intake stroke is detected by rotation of a crank shaft.

5. An electronically controlled fuel injection method as defined in claim 4, wherein computation of a rate of fuel being injected is executed by a micro-processor.

* * * * *